US011195479B2

(12) United States Patent
Xi et al.

(10) Patent No.: US 11,195,479 B2
(45) Date of Patent: Dec. 7, 2021

(54) DISPLAY DEVICE AND METHOD FOR DRIVING THE SAME, DRIVING APPARATUS AND COMPUTER-READABLE MEDIUM

(71) Applicant: BOE TECHNOLOGY GROUP CO., LTD., Beijing (CN)

(72) Inventors: Yanhui Xi, Beijing (CN); Xiaomang Zhang, Beijing (CN); Yan Sun, Beijing (CN); Zhihua Ji, Beijing (CN); Yuxin Bi, Beijing (CN); Tiankuo Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/763,762

(22) PCT Filed: Nov. 5, 2019

(86) PCT No.: PCT/CN2019/115712
§ 371 (c)(1),
(2) Date: May 13, 2020

(87) PCT Pub. No.: WO2020/094006
PCT Pub. Date: May 14, 2020

(65) Prior Publication Data

US 2021/0225299 A1 Jul. 22, 2021

(30) Foreign Application Priority Data

Nov. 9, 2018 (CN) ..... 201811336651.2

(51) Int. Cl.
*G09G 5/10* (2006.01)
*G09G 3/34* (2006.01)
*G09G 3/36* (2006.01)

(52) U.S. Cl.
CPC ..... *G09G 3/3426* (2013.01); *G09G 5/10* (2013.01); *G09G 3/3607* (2013.01); *G09G 2320/0271* (2013.01)

(58) Field of Classification Search
CPC ..... G09G 5/10; G09G 3/3607; G09G 2320/0271; G09G 3/3426; G09G 3/342;
(Continued)

(56) References Cited

U.S. PATENT DOCUMENTS 8,531,381 B2 9/2013 Feng
8,610,654 B2 12/2013 Kerofsky et al.
(Continued)

FOREIGN PATENT DOCUMENTS

CN 102165514 A 8/2011
CN 102625065 A 8/2012
(Continued)

OTHER PUBLICATIONS

Office Action dated Nov. 21, 2019, issued in counterpart JP application No. 201811336651.2, with English translation. (15 pages).
(Continued)

*Primary Examiner* — Rodney Amadiz
(74) *Attorney, Agent, or Firm* — Westerman, Hattori, Daniels & Adrian, LLP

(57) ABSTRACT

The present disclosure relates to a method for driving a display device, a driving apparatus, a display device, and a computer-readable medium. The display device includes a backlight module, which includes a plurality of backlight regions. The method includes: determining a first backlight signal value of each of the plurality of backlight regions according to input grayscale values of pixels in an image to be displayed; determining a second backlight signal value of each of the plurality of backlight regions according to the first backlight signal values of the plurality of backlight
(Continued)

regions and a preset backlight diffusion function; and driving each of the plurality of backlight regions to emit light using the second backlight signal value of the backlight region.

14 Claims, 6 Drawing Sheets

(58) Field of Classification Search
CPC ..... G09G 3/36; G09G 2320/0646; G09G 2330/021; G09G 2330/023; G09G 2320/062; G09G 2360/16; G09G 2320/0238; G09G 2320/0653; G09G 2320/066; G09G 3/3406
See application file for complete search history.

(56) References Cited

U.S. PATENT DOCUMENTS

| | | | | |
|---|---|---|---|---|
| 10,783,837 | B2 | 9/2020 | Sun et al. | |
| 10,930,225 | B2 * | 2/2021 | Ji | G09G 3/36 |
| 10,984,736 | B2 * | 4/2021 | Xi | G09G 3/3426 |
| 11,024,238 | B2 | 6/2021 | Zha | |
| 2010/0079364 | A1 | 4/2010 | Feng | |
| 2018/0182356 | A1 * | 6/2018 | Seong | G09G 5/10 |
| 2019/0038001 | A1 | 2/2019 | Legastelois et al. | |
| 2019/0147804 | A1 * | 5/2019 | Zha | G09G 3/3406 345/691 |
| 2019/0355313 | A1 | 11/2019 | Sun et al. | |
| 2021/0020116 | A1 * | 1/2021 | Sun | G09G 3/3426 |
| 2021/0082355 | A1 | 3/2021 | Zha | |

FOREIGN PATENT DOCUMENTS

| | | | |
|---|---|---|---|
| CN | 103824262 | A | 5/2014 |
| CN | 104240650 | A | 12/2014 |
| CN | 104637455 | A | 5/2015 |
| CN | 107507580 | A | 12/2017 |
| CN | 108428436 | A | 8/2018 |
| CN | 108564923 | A | 9/2018 |
| CN | 108665857 | A | 10/2018 |
| CN | 109243384 | A | 1/2019 |
| EP | 3147893 | A1 | 3/2017 |

OTHER PUBLICATIONS

Office Action dated Nov. 21, 2019, issued in counterpart CN application No. 201811336651.2, with English translation. (15 pages).

* cited by examiner

DISPLAY DEVICE AND METHOD FOR DRIVING THE SAME, DRIVING APPARATUS AND COMPUTER-READABLE MEDIUM

CROSS-REFERENCE TO RELATED APPLICATION(S)

This application claims priority to the Chinese Patent Application No. 201811336651.2, filed on Nov. 9, 2018, which is incorporated herein by reference in its entirety.

TECHNICAL FIELD

The present disclosure relates to the field of display technology, and more particularly, to a display device and a method for driving the same, a driving apparatus, and a computer-readable medium.

BACKGROUND

For the purpose of control of a display device such as a liquid crystal display etc., a local dimming method may be adopted in order to reduce power consumption of the display device, increase a contrast of a display screen, and reduce afterimages etc. This local dimming method is to divide a backlight source of the display device into a plurality of backlight regions, and then independently control the respective backlight regions.

However, in an implementation process, since compensation for transmittance of a Liquid Crystal Display (LCD) does not match a variation in backlight, it results in a "bright block phenomenon" of display, which affects the display effect.

SUMMARY

Embodiments of the present disclosure propose a display device and a method for driving the same, a driving apparatus, and a computer-readable medium.

According to an aspect of the present disclosure, there is proposed a method for driving a display device comprising a backlight module, the backlight module comprising a plurality of backlight regions, and the method comprising:

determining a first backlight signal value of each of the plurality of backlight regions according to input grayscale values of pixels in an image to be displayed:

determining a second backlight signal value of each of the plurality of backlight regions according to the first backlight signal values of the plurality of backlight regions and a preset backlight diffusion function; and driving each of the plurality of backlight region to emit light using the second backlight signal value of the backlight region.

In an example, determining a second backlight signal value of each of the plurality of backlight region according to the first backlight signal values of the plurality of backlight regions and a preset backlight diffusion function comprises: obtaining the second backlight signal value of each of the plurality of backlight region through an iterative operation based on the first backlight signal values of the plurality of backlight regions and the preset backlight diffusion function.

In an example, the iterative operation comprises:

$$F_{k+1}=F_k+\beta\cdot(G-H*F_k)$$

wherein $F_k$ is a set of second backlight signal values of the plurality of backlight regions obtained in a $k^{th}$ iteration, $F_{k+1}$ is a set of second backlight signal values of the plurality of backlight regions obtained in a $(k+1)^{th}$ iteration, k is an integer greater than or equal to 0, β and ε are preset constants, G is a set of first backlight signal values of the plurality of backlight regions, and H is the preset backlight diffusion function and is a g×g Gaussian function matrix, wherein g is equal to (2×j+1), and j is a natural number.

In an example, obtaining the second backlight signal value by using an iterative operation comprises: in a condition where $$\frac{\|F_{k+1}-F_k\|}{\|F_k\|}\le\varepsilon$$

is satisfied, using the set $F_{k+1}$ of second backlight signal values obtained in the $(k+1)^{th}$ iteration as the obtained set of second backlight signal values; otherwise, incrementing an iteration number k by 1 and repeating the iterative operation.

In an example, $F_0=\beta\times G$. In an example, $0<\beta<1$. In an example, $0<\varepsilon<0.1$. In an example, $0<\beta<1$ and $0<\varepsilon<0.1$.

In an example, determining the first backlight signal values of the plurality of backlight regions comprises: for each of the plurality of backlight regions, calculating statistical information of input grayscale values of pixels in a sub-display region corresponding to the backlight region; and determining a first backlight signal value of the backlight region according to the statistical information.

In an example, the statistical information comprises one of a maximum value, a mean value, or a histogram distribution value of the input grayscale values of the pixels in the sub-display region.

In an example, the method according to the embodiment of the present disclosure further comprises: determining actual backlight values of the pixels in the image to be displayed according to the determined second backlight signal values and the preset backlight diffusion function; determining output grayscale values of the pixels according to the actual backlight values of the pixels and the input grayscale values of the pixels; and driving a display panel to display the image to be displayed using the determined output grayscale values of the pixels.

According to another aspect of the embodiments of the present disclosure, there is provided a driving apparatus, comprising:

a memory configured to have instructions stored therein; and a processor configured to:

execute the instructions stored in the memory to implement the method according to the embodiment of the present disclosure.

According to another aspect of the embodiments of the present disclosure, there is provided a display device, comprising:

a display panel, comprising a plurality of sub-display regions;

a backlight module comprising a plurality of backlight regions; and the driving apparatus according to the embodiment of the present disclosure.

According to another aspect of the embodiments of the present disclosure, there is provided a non-transitory computer-readable storage medium having stored therein instructions which are configured to, when executed by at least one processor, implement the method according to the embodiment of the present disclosure.

BRIEF DESCRIPTION OF THE ACCOMPANYING DRAWINGS

The above and other purposes, features, and advantages of the embodiments of the present disclosure will be made clearer by describing the embodiments of the present disclosure with reference to the accompanying drawings. It should be illustrated that throughout the accompanying drawings, the same elements are denoted by the same or similar reference signs. In the accompanying drawings.

DETAILED DESCRIPTION

Figure 1A:
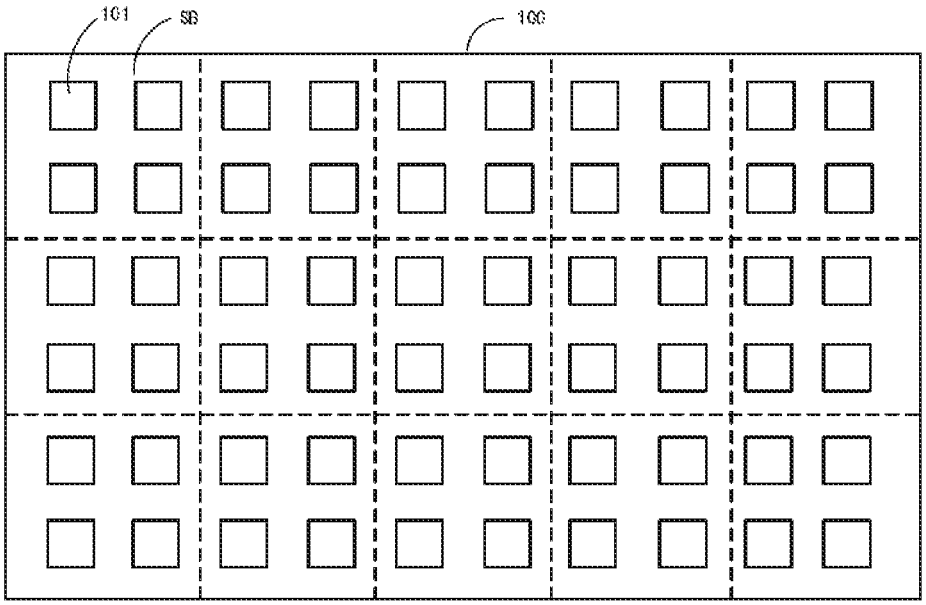
FIG. 1A illustrates a schematic diagram of division of regions of an LED backlight module.

In order to make the purposes, technical solutions, and advantages of the embodiments of the present disclosure more clear, the technical solutions according to the embodiments of the present disclosure will be described clearly and completely below in combination with the accompanying drawings of the embodiments of the present disclosure. Obviously, the described embodiments are a part of the embodiments of the present disclosure, but not all the embodiments. All other embodiments obtained by those of ordinary skill in the art based on the described embodiments of the present disclosure without any creative work shall fall within the protection scope of the present disclosure. In the following description, some specific embodiments are for descriptive purposes only, and should not be construed as limiting the present disclosure, but are merely examples of the embodiments of the present disclosure. Conventional structures or configurations will be omitted when they may cause confusion to the understanding of the present disclosure. It should be illustrated that shapes and sizes of components in the figures do not reflect true sizes and proportions, but only illustrate contents of the embodiments of the present disclosure.

In addition, in the description of the embodiments of the present disclosure, the term "connected to" or "connected with" may mean that two components are directly connected, or may mean that two components are connected via one or more other components. In addition, these two components may be connected or coupled in a wired or wireless manner.

In addition, in the description of the embodiments of the present disclosure, unless defined otherwise, the technical or scientific terms used in the present disclosure shall have the ordinary meanings understood by those of ordinary skill in the art to which the present disclosure belongs. The words such as "first", "second", etc. used in the present disclosure do not indicate any order, quantity, or importance, but are only used to distinguish different components. Similarly, the words such as "a", "an", or "the" etc. do not indicate limitations on quantity, but rather indicate presence of at least one. The word such as "comprising" or "including" etc. means that an element or item preceding the word encompasses elements or parts which appear after the word and their equivalents, but does not exclude other elements or parts.

For example, for a liquid crystal display panel, a backlight module may be controlled by using a local dimming method, thereby improving display quality of the display panel. The local dimming method may not only reduce power consumption of the display panel, but also may realize dynamic dimming of the backlight module, which enhances a contrast of a display image, and improves display quality of the display panel.

The local dimming method is essentially to divide a backlight source or backlight module of a display device into a plurality of backlight regions which may be driven individually, and then independently control the respective backlight regions. Each of the backlight regions may comprise one or more Light-Emitting Diodes (LEDs) as light sources. Driving current of LEDs of backlight regions corresponding to sub-display regions is adjusted according to grayscale values required by an image to be displayed of a display screen, so that brightness of the respective regions in the backlight module may be adjusted individually.

FIG. 1A illustrates a schematic diagram of division of backlight regions of an LED backlight module. As shown in FIG. 1A, the backlight module 100 comprises a plurality of LED units 101, and each square in the figure represents one LED unit 101. A plurality of regions separated by dotted lines represent a plurality of backlight regions SB. In the example of FIG. 1A, each backlight region SB may comprise four LED units 101, and the respective backlight regions SB may be controlled independently of each other. For example, the LED units 101 in each backlight region SB are linked, that is, current applied to the respective LED units 101 in the same backlight region SB is consistent.

Figure 1B:
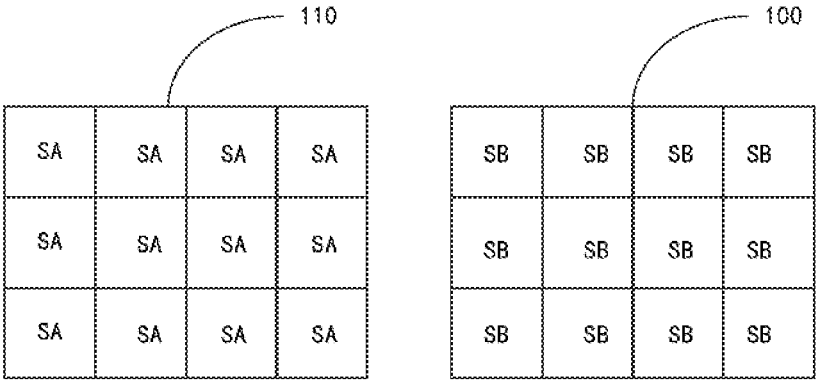
FIG. 1B illustrates a schematic diagram of a display panel and a backlight module in a display device.

FIG. 1B illustrates a schematic diagram of a display panel and a backlight module in a display device. As shown in FIG. 1B, a display region of a display panel 110 may be divided into a plurality of sub-display regions SA corresponding to a plurality of backlight regions SB of the backlight module 100 respectively. Here, the so-called "correspondence" may refer to correspondence in position. For example, as shown in FIG. 1B, the sub-display regions SA and the backlight regions SB may be divided in the same manner, so that a sub-display region SA on a first row and a first column on the display panel 110 corresponds to a backlight region SB on a first row and a first column on the backlight module 100, and a sub-display region SA on the first row and a second column on the display panel 110 corresponds to a backlight region SB on the first row and a second column on the backlight module 100, and so on. The inventors of the present application realized that visual brightness of a certain sub-display region SA mainly depends on light transmittance of the sub-display region SA and brightness of a backlight region SB corresponding to the sub-display region SA. Meanwhile, the light transmittance of the certain sub-display region SA depends on a deflection angle of a light valve of, for example, liquid crystal molecules, which is affected by an applied electric field, and the deflection angle is related to a data signal (i.e., grayscale values of pixels in an image to be displayed) provided to the sub-display region SA. Therefore, it may be considered that the visual brightness of the sub-display region SA is determined by the data signal provided to the sub-display region SA and a backlight signal value of the backlight region SB corresponding to the sub-display region SA. Thus, the brightness of the backlight region SB may be adjusted according to the original grayscale values of respective pixels in the image to be displayed on the display panel 110. For a portion (sub-display region SA) of a display screen with high brightness (grayscale values), a corresponding backlight region SB also has high brightness, and for a portion(sub-display region SA) of the display screen with low brightness, a corresponding backlight region SB also has low brightness, so as to reduce power consumption of the backlight, enhance a contrast of the display screen and improve display image quality.

However, light emitted by the LED units 101 has a certain diffusion angle, which causes light emitted by the LED units 101 of each backlight region SB to affect adjacent backlight regions SB. After mutual coupling, there is a deviation between final display brightness of each backlight region SB and desired brightness, which results in "a portion which should be bright is not bright enough, and a portion which should be dark is not dark enough". For example, light emitted by LED units of a backlight region SB which requires bright display may be diffused to adjacent backlight regions SB which are relatively dark, and thereby, display brightness of the backlight region SB which requires bright display may not reach display brightness actually required for a display screen, and display brightness of the backlight regions SB which require dark display exceeds display brightness actually required for a display screen.

According to the embodiments of the present disclosure, there is proposed a method for driving a display device. It may be understood by those skilled in the art that sequence numbers of various steps in the following method are only used as representation of the steps for convenience of description, and should not be regarded as representing an execution order of the respective steps. Unless explicitly stated, the steps of the method need not be performed in an exact order shown, or some steps may be performed simultaneously.

Figure 2:
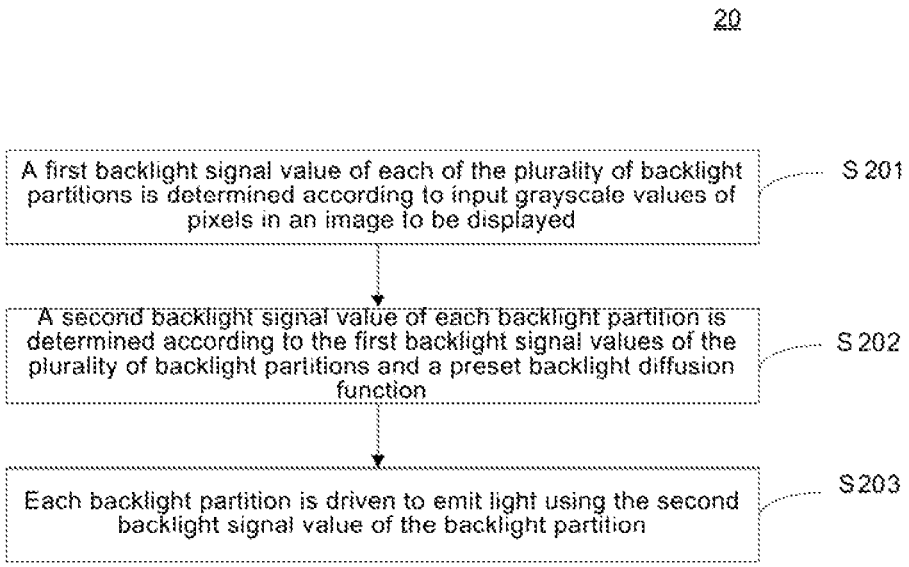
FIG. 2 illustrates a flowchart of a method for driving a display device according to an embodiment of the present disclosure.

FIG. 2 illustrates a schematic flowchart of a method 20 for driving a display device according to an embodiment of the present disclosure. For example, the display device may comprise a backlight module, which may comprise a plurality of backlight regions. As shown in FIG. 2, the method 20 for driving a display device according to the embodiment of the present disclosure may comprise the following steps.

In step S201, a first backlight signal value of each of the plurality of backlight regions is determined according to input grayscale values of pixels in an image to be displayed.

In step S202, a second backlight signal value of each backlight region is determined according to the first backlight signal values of the plurality of backlight regions and a preset backlight diffusion function.

In step S203, each backlight region is driven to emit light using the second backlight signal value of the backlight region.

Next, the method 20 according to the embodiment of the present disclosure will be described in detail with reference to the accompanying drawings.

According to an embodiment of the present disclosure, the "input grayscale values of pixels" may refer to original pixel grayscale values of the image to be displayed. In step S201, determining the first backlight signal values of the plurality of backlight regions may comprise: for each of the plurality of backlight regions, calculating statistical information of input grayscale values of pixels in a sub-display region corresponding to the backlight region; and determining a first backlight signal value of the backlight region according to the statistical information. The statistical information may comprise one of a maximum value, a mean value, or a histogram distribution value of the input grayscale values of the sub-display region.

According to an embodiment of the present disclosure, in step S201, spatial domain conversion may further be performed on the image to be displayed. For example, the image to be displayed may be an RGB image with a resolution of W×H. The original input image in a RGB format may be converted into HSV (Hue, Saturation and Value) color space format, so that hue components, saturation components and brightness components of the original image are separated, and the components V are used as the input grayscale values of the pixels in subsequent processing to preserve brightness of the original image as much as possible. It may be understood by those skilled in the art that the RGB-HSV color space conversion may be performed using various methods, so that the components V obtained by using the HSV conversion may be grayscale values of 0 to 255, which will not be described in detail here for simplicity.

For each sub-display region $SA_i$, a maximum value of input grayscale values of pixels in the sub-display region $SA_i$ may be directly selected as a first backlight signal value of a corresponding backlight region $SB_i$, wherein $1<i\leq I$, and I is a number of the backlight regions. It may be understood by those skilled in the art that a number of the sub-display regions $SA_i$ is the same as that of the backlight regions SB. In addition, a mean value of the input grayscale values of the pixels in the sub-display region $SA_i$ may be used as the first backlight signal value of the corresponding backlight region $SB_i$. Alternatively, a histogram distribution value of the input grayscale values of the pixels in the sub-display region SA, may be used as the first backlight signal value of the corresponding backlight region SB, which is not limited in the embodiments of the present disclosure.

For example, calculating the histogram distribution value of the input grayscale values of the pixels in the sub-display region $SA_i$ may comprise: calculating a pixel number distribution of the respective input grayscale values (for example, 0 to 255) of the pixels in the sub-display region $SA_i$, and calculating a Cumulative Distribution Function (CDF) value of the input grayscale values in each sub-display region according to the pixel number distribution, which will not be described in detail in the embodiments of the present disclosure for simplicity.

According to an embodiment of the present disclosure, in step S202, the second backlight signal value of each backlight region is determined according to the first backlight signal values of the plurality of backlight regions and the preset backlight diffusion function. For example, the second backlight signal value of each backlight region may be obtained by using an iterative operation based on the preset backlight diffusion function and the first backlight signal values of the plurality of backlight regions. A set F of second backlight signal values of the respective backlight regions is inversely inferred through the iterative operation using a set G of first backlight signal values of the plurality of backlight regions and the preset backlight diffusion function H, so that a result of H*F is as close to G as possible.

Figure 3:
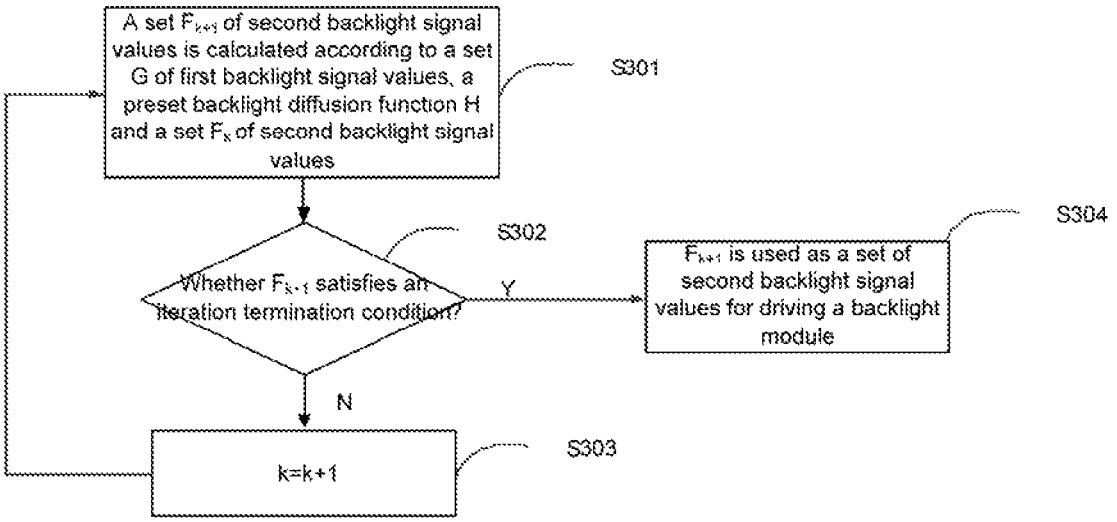
FIG. 3 illustrates a flowchart of an exemplary method 300 for determining second backlight signal values according to first backlight signal values and a preset backlight diffusion function according to an embodiment of the present disclosure.

FIG. 3 illustrates a flowchart of an exemplary method 300 for determining second backlight signal values according to first backlight signal values and a preset backlight diffusion function according to an embodiment of the present disclosure. As shown in FIG. 3, the method 300 according to the embodiment of the present disclosure may comprise the following steps.

In step S301, a set $F_{k+1}$ of second backlight signal values is calculated according to a set G of first backlight signal values, a preset backlight diffusion function and a set $F_k$ of second backlight signal values, wherein subscripts k and k+1 represent numbers of iterations, and k is an integer greater than or equal to 0. For example, $F_k$ is a set of second backlight signal values of the plurality of backlight regions obtained in a $k^{th}$ iteration, and $F_{k+1}$ is a set of second backlight signal values of the plurality of backlight regions obtained in a $(k+1)^{th}$ iteration. For example, iterative calculation may start from k=0.

In step S302, it is determined whether $F_{k+1}$a satisfies an iteration termination condition.

In step S303, if it is determined in step S302 that $F_k+_1$ does not satisfy the iteration termination condition, k is incremented by 1, and the process returns to step S301.

In step S304, if it is determined in step S302 that $F_k$+i satisfies the iteration termination condition, $F_k$+i is output as a set of second backlight signal values for driving a backlight module.

Next, the exemplary method shown in FIG. 3 will be described in detail.

In step S301, the set $F_{k+1}$ of second backlight signal values is calculated according to the set G of first backlight signal values of the plurality of backlight regions, the preset backlight diffusion function, and the set $F_k$ of second backlight signal values. According to an embodiment of the present disclosure, when k is equal to 0, initial values $F_0$ of the backlight signal values $F_k$ may be calculated according to the following formula (1).

$$F_0=\beta*G \tag{1}$$

wherein G is the set of first backlight signal values of the plurality of backlight regions, and β is a preset constant. According to an embodiment of the present disclosure, G may be a matrix composed of the plurality of first backlight signal values acquired in the above step S201, and may also be referred to as a first backlight signal value matrix G. For example, in a case where the backlight module is divided into I backlight regions $SB_i$ for I sub-display regions $SA_i$ respectively, the first backlight signal value matrix G may comprise I elements, wherein an $i^{th}$ element represents statistical information of an $i^{th}$ sub-display region $SA_i$, and 1≤i≤1. It may be understood by those skilled in the art that the matrix G may be a 1×I, I×1 or m×n matrix, wherein m and n are numbers of rows and columns of the backlight regions in the backlight module respectively, and m×n=I. In the following example, for convenience of description, description is made by taking the matrix G being an I×1 matrix as an example, that is, $$G=\begin{bmatrix} G_1 \\ G_2 \\ G_3 \\ \vdots \\ G_I \end{bmatrix},$$

wherein $G_1$, $G_2$, $G_3$, . . . and $G_I$ are the first backlight signal values obtained in step S201 respectively.

According to an embodiment of the present disclosure, when k is greater than or equal to 0. $F_{k+1}$ may be calculated using the following formula (2).

$$F_{k+1}=F_k+\beta\times(G-H*F_k) \tag{2}$$

wherein H is the preset backlight diffusion function. For example, H may be a g×g Gaussian function matrix, wherein g is equal to (2×j+1), j is a natural number, and an operator "*" represents a convolution operation. According to an embodiment of the present disclosure, the backlight diffusion function H is used as a convolution kernel to be convolved with $F_k$, and an iterative operation is performed to obtain $F_{k+1}$, so that $H*F_{k+1}$ is as close to G as possible.

For example, H may be a 3×3, 5×5 or 7×7 Gaussian fuzzy function matrix. Tables 1A to 1C below respectively show examples of the 3×3, 5×5 and 7×7 Gaussian fuzzy function matrixes each of which may be used as the preset backlight diffusion function.

TABLE 1A

| Template examples of 3 × 3 Gaussian fuzzy matrix | | |
|---|---|---|
| 1.47169e−005 | 0.00380683 | 1.47169e−005 |
| 0.00380683 | 0.984714 | 0.00380683 |
| 1.47169e−005 | 0.00380683 | 1.47169e−005 |

TABLE 1B

| Template examples of 5 × 5 Gaussian fuzzy matrix | | | | |
|---|---|---|---|---|
| 6.58573e−006 | 0.000424781 | 0.00170354 | 0.000424781 | 6.58573e−006 |
| 0.000424781 | 0.0273984 | 0.109878 | 0.0273984 | 0.000424781 |
| 0.00170354 | 0.109878 | 0.440655 | 0.109878 | 0.00170354 |
| 0.000424781 | 0.0273984 | 0.109878 | 0.0273984 | 0.000424781 |
| 6.58573e−006 | 0.000424781 | 0.00170354 | 0.000424781 | 6.58573e−006 |

TABLE 1C

| Template examples of 7 × 7 Gaussian fuzzy matrix | | | | | | |
|---|---|---|---|---|---|---|
| 0.0000006 | 0.0000229 | 0.0001911 | 0.0003877 | 0.0001911 | 0.0000229 | 0.0000006 |
| 0.0000229 | 0.0007863 | 0.0065596 | 0.0133037 | 0.0065596 | 0.0007863 | 0.0000229 |
| 0.0001911 | 0.0065596 | 0.0547215 | 0.1109816 | 0.0547215 | 0.0065596 | 0.0001911 |
| 0.0003877 | 0.0133037 | 0.1109816 | 0.2250835 | 0.1109816 | 0.0133037 | 0.0003877 |
| 0.0001911 | 0.0065596 | 0.0547215 | 0.1109816 | 0.0547215 | 0.0065596 | 0.0001911 |
| 0.0000229 | 0.0007863 | 0.0065596 | 0.0133037 | 0.0065596 | 0.0007863 | 0.0000229 |
| 0.0000006 | 0.0000229 | 0.0001911 | 0.0003877 | 0.0001911 | 0.0000229 | 0.0000006 |

In addition, according to an embodiment of the present disclosure, β is a preset constant and 0<β<1. For example, β=0.8. The larger the value of β, the higher the accuracy, but the larger the number of iterations, and the greater the amount of calculation. Those skilled in the art may set the value of β according to practical situations.

For example, G may be an I×1 matrix, for example, $$G = \begin{bmatrix} G_1 \\ G_2 \\ G_3 \\ \vdots \\ G_I \end{bmatrix}.$$

According to an embodiment of the present disclosure, $G_1$, $G_2$, $G_3$, . . . and $G_I$ may be statistical information corresponding to I sub-display regions respectively, and each of $G_1$, $G_2$, $G_3$, . . . and $G_I$ comprises, but not limited to, one of a maximum value, a mean value or a histogram distribution value of input grayscale values of pixels of an image to be displayed in a sub-display region. H may be a g×g matrix, wherein g is an odd number, for example, $$H = \begin{bmatrix} h_{11} & \cdots & h_{1g} \\ \vdots & \ddots & \vdots \\ h_{g1} & \cdots & h_{gg} \end{bmatrix}.$$

It may be understood by those skilled in the art that $F_{k+1}$ obtained according to the above formula (2) is an I×1 matrix, for example, $$F_{k+1} = \begin{bmatrix} F_{k+1_1} \\ F_{k+1_2} \\ F_{k+1_3} \\ \vdots \\ F_{k+1_I} \end{bmatrix}.$$

Each element in the matrix $F_{k+1}$ represents a second backlight signal value of a corresponding one backlight region obtained in the $(k+1)^{th}$ iteration, for example, $F_{k+1_1}$, represents a second backlight signal value of a backlight region $SB_1$ obtained in the $(k+1)^{th}$ iteration. $F_{k+1_2}$ represents a second backlight signal value of a backlight region $SB_2$ obtained in the $(k+1)^{th}$ iteration, and so on.

Next, in step S302, it is determined whether $F_{k+1}$ obtained in step S301 satisfies the iteration termination condition. It may be determined whether $F_{k+1}$ satisfies the iteration termination condition according to the following formula (3).

$$\frac{\|F_{k+1} - F_k\|}{\|F_k\|} \leq \varepsilon \tag{3}$$

According to an embodiment of the present disclosure, ε is a preset constant and 0<ε<0.1. For example, ε=0.05. The larger the value of ε, the higher the accuracy and the lower the distortion rate, but the larger the number of iterations, and the greater the amount of calculation. Those skilled in the art may set the value of ε according to practical situations.

Next, in step S303, if it is determined in step S302 that $F_{k+1}$ does not satisfy the iterative termination condition shown in, for example, formula (3) k is incremented by 1, i.e., k=k+1, $F_k=F_{k+1}$, and the process returns to step S301 to perform the iterative operations of S301 to S302.

In step S304, if it is determined in step S302 that $F_{k+1}$ satisfies the iteration termination condition shown in, for example, formula (3) the current $F_{k+1}$ is output as the second backlight signal values.

Next, in step S203, the backlight module is driven to emit light using $$F_{k+1} = \begin{bmatrix} F_{k+1_1} \\ F_{k+1_2} \\ F_{k+1_3} \\ \vdots \\ F_{k+1_I} \end{bmatrix}$$

output in step S304 as the second backlight signal values.

It should be illustrated that in step S201, the pixel input grayscale values of the image to be displayed are used to calculate the statistical information of the respective sub-display regions to obtain the first backlight signal values G, $G_1$, $G_2$, $G_3$, . . . and $G_I$ are still substantially in a form of grayscale values, and therefore $F_{k+1_1}$, $F_{k+1_2}$, $F_{k+1_3}$, . . . and $F_{k+1_I}$ output in step S304 are in a form of grayscale values. $F_{k+1_1}$, $F_{k+1_2}$, $F_{k+1_3}$, . . . and $F_{k=1_I}$ may be converted into corresponding driving current $Current_1$, $Current_2$, $Current_3$, . . . and $Current_I$ respectively, which are applied to LED units in the backlight regions $SB_1$, $SB_2$, $SB_3$, . . . , and $SB_I$ respectively to drive the LED units to emit light with corresponding brightness as the backlight of the display panel.

It may be understood by those skilled in the art that, since different preset diffusion functions H are used, the second backlight signal values $F_{k+1_1}$, $F_{k+1_2}$, $F_{k+1_3}$, . . . and $F_{k+1_I}$ obtained by using the exemplary iterative processing in FIG. 3 may have a value greater than the highest backlight value. According to an embodiment of the present disclosure, the term "highest backlight value" may refer to a grayscale value corresponding to maximum rated current driving an LED unit. For example, in a case where a grayscale value is expressed by 8 bytes, the highest backlight value is 255. Of course, in a case where a grayscale value is expressed by 10 bytes, the highest backlight value is 1023. In a case where a backlight module is given, the "highest backlight value" is usually a constant. Therefore, according to an embodiment of the present disclosure, if $F_{k+1_i}$ among the second backlight signal values $F_{k+1_1}$, $F_{k+1_2}$, $F_{k+1_3}$, . . . and $F_{k+1_i}$ is greater than the highest backlight value, truncation processing is performed on $F_{k+1_i}$ which is greater than the highest backlight value (for example, 255), so that $F_{k+1_i}$=255.

Figure 4:
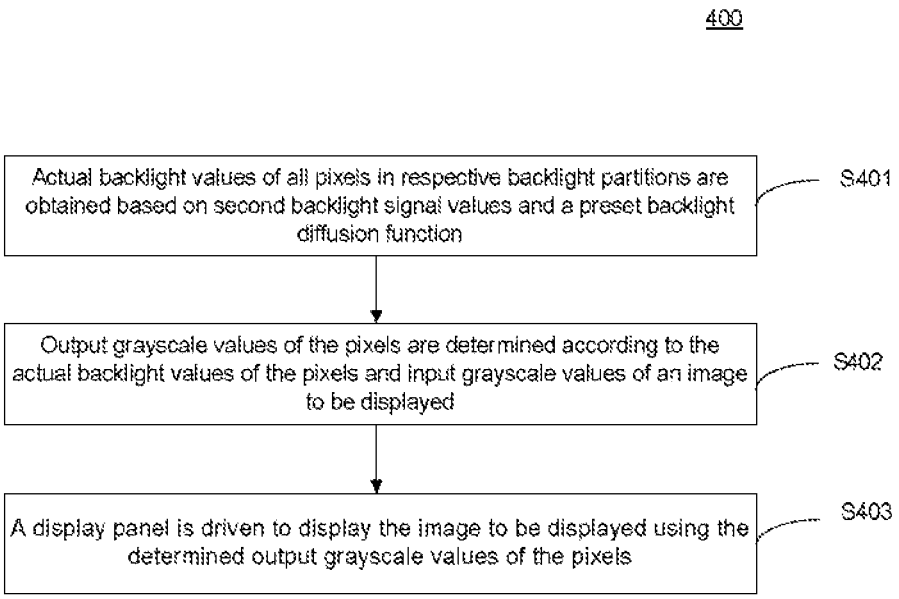
FIG. 4 illustrates a flowchart of an exemplary method for performing image display processing according to an embodiment of the present disclosure.

After the set $F_{k+1}$ of second backlight signal values of the respective backlight regions is obtained, the method according to the embodiment of the present disclosure may further comprise: performing image display processing on the image to be displayed according to the determined second backlight signal values to enhance a contrast of the image to be displayed. FIG. 4 illustrates a flowchart of an exemplary image display processing method according to an embodiment of the present disclosure. As shown in FIG. 4, the image display processing method may comprise the following steps.

In step S401, actual backlight values of all pixels in respective backlight regions are obtained based on second backlight signal values and a preset backlight diffusion function.

In step S402, output grayscale values of the pixels are determined according to the actual backlight values of the pixels and input grayscale values of pixels in an image to be displayed.

In step S403, a display panel is driven to display the image to be displayed using the determined output grayscale values of the pixels.

In step S401, the actual backlight values of all the pixels in the respective backlight regions are obtained based on a set $F_{k+1}$ of second backlight signal values and a preset backlight diffusion function H. According to an embodiment of the present disclosure, the "actual backlight values of pixels" may be understood as compensation for visual brightness of the respective pixels in the image to be displayed by brightness of the backlight regions. Hereinafter, description is made by taking acquisition of an actual backlight value of a certain pixel p corresponding to a backlight region $SB_i$ as an example. It may be understood by those skilled in the art that the pixel p is substantially a pixel in a sub-display region $SA_i$ corresponding to the backlight region $SB_i$.

In the above step S203, each LED unit in the backlight region SB; is driven by driving current $Current_i$ based on the second backlight signal value $F_{k+1_i}$ to emit light with corresponding brightness. The light emitted by the LED unit may cause phenomena such as light diffusion etc. Therefore, backlight emitted by LED units located at different positions in the backlight module affects the actual backlight value of the pixel p. For example, the less the distance between the pixel p and a certain LED unit, the greater the influence of brightness emitted by the LED unit on the actual backlight value of the pixel p. Therefore, couplings of brightness of backlight emitted by the respective LED units at the different positions in the backlight module to the pixel p are combined to obtain the actual backlight value of the pixel. At the same time, the influence of backlight emitted by an LED unit outside the backlight region $SB_i$ on the pixel p may be minimized. According to an embodiment of the present disclosure, the actual backlight value of the pixel p is calculated using the preset diffusion function H. For example, the actual backlight value of the pixel p may be obtained using the following formula.

$$BLU_{psf_p}=f(H,F_{k+1}') \tag{4}$$

wherein H is the preset diffusion function according to the embodiment of the present disclosure, $F_{k+1}'$ is second backlight values among the acquired second backlight values $F_{k+1_1}$, $F_{k+1_2}$, $F_{k+1_3}$, . . . and $F_{k+1_I}$ for which backlight regions are considered to have influence on brightness of pixels in the sub-display region $SA_i$. It may be understood that $F_{k+1}'$ is a subset of $F_{k+1}$. $f$ represents a functional relationship between $BLU_{psf_p}$ and H and $F_{k+1}'$.

It may be understood by those skilled in the art that H substantially represents diffusion weights of the respective backlight regions (or backlight sources) with respect to the pixel p, and is related to distances between the pixel p and the respective backlight regions. According to an embodiment of the present disclosure, the acquired second backlight signal values of the plurality of backlight regions are diffused to all pixels in the respective sub-display regions through the preset diffusion function H, to obtain the actual backlight value of each pixel. According to an embodiment of the present disclosure, the function $f$ may comprise a convolution operation. In order to improve the accuracy of processing, the function $f$ may further comprise normalization processing, data interpolation and fitting etc., and the actual backlight value of each pixel is obtained according to a curve obtained by fitting. It may be understood by those skilled in the art that various methods may be used to perform backlight diffusion to obtain the actual backlight value of each pixel, and the embodiments of the present disclosure are not limited to the above examples.

In step S402, the output grayscale values of the pixels are determined according to the actual backlight values of the pixels and the input grayscale values of the image to be displayed. Since display brightness of each pixel in the display panel at a certain time is not only related to an actual backlight value of the pixel at that time, but also is related to display data (i.e., a grayscale value, which determines transmittance) of the pixel, it is necessary to compensate for the display data (i.e., the input grayscale value of the pixel) of the pixel to obtain an output grayscale value, so that ideal display brightness of the display panel is achieved. For example, in order to achieve ideal display effects, the actual backlight value $BLU_{psf_p}$ of each pixel in the backlight region is obtained according to formula (4), transmittance of each pixel is calculated, and after the transmittance is obtained, an output grayscale value $V_{output_p}$ of each pixel is calculated according to formula (5) to achieve display compensation for display data of a display screen.

For example, the output grayscale value $V_{output_p}$ of the pixel p may be calculated by the following formula.

$$V_{output_p}=BLU_{psf_p}\times\eta_P \tag{5}$$

wherein $V_{output_p}$ represents the output grayscale value of the pixel p, $BLU_{psf_p}$ represents the actual backlight value of the pixel p, and $\eta_P$ represents the transmittance of the pixel p.

In one example, the transmittance $\eta_P$ may be expressed as:

$$\eta_P = \left(\frac{V_{input_p}}{V_{max}}\right)^{\gamma} \times \eta_{max} \quad (6)$$

wherein $V_{input_p}$ represents the input grayscale value of the pixel p, $V_{max}$ represents the highest backlight value, for example 255, γ is a preset constant and may be related to a gamma value of the display device, for example γ=2.2, and $\eta_{max}$ is transmittance corresponding to the highest backlight value. It may be understood by those skilled in the art that, in a case where a display panel is given, $V_{max}$, γ and $\eta_{max}$ are all constants.

It may be understood by those skilled in the art that the output grayscale value of each pixel obtained above is substantially a component V in the HSV space. When the display panel is driven, it is necessary to convert the output grayscale value of each pixel from the HSV color space to an RGB data signal for display. The conversion from the HSV color space to the RGB data signal may be achieved using an inverse transform of the RGB-HSV transform used in step 201.

In addition, it may be understood by those skilled in the art that the display image processing described with reference to FIG. 4 may not be performed, and instead, the input grayscale values of the pixels in the image to be displayed may be used to directly drive the display panel to perform image display.

With the driving method according to the embodiment of the present disclosure, the contrast of the display image is improved while reducing the power consumption of backlight of the backlight module. In addition, with the method according to the embodiment of the present disclosure, there is no need to perform peak driving, which may avoid problems such as premature aging of light emitting devices of backlight units caused by the display panel being in a state of peak driving for a long time, thereby avoiding the influence on the overall life of the display panel.

It should be illustrated that, in various embodiments of the present disclosure, the flow of the driving method may comprise more or fewer operations, which may be performed sequentially or in parallel. Although the flow of the image display processing method described above comprises a plurality of operations occurring in a specific order, it should be clearly understood that the order of the plurality of operations is not limited. The driving method described above may be implemented once or may also be implemented multiple times according to predetermined conditions.

Figure 5A:
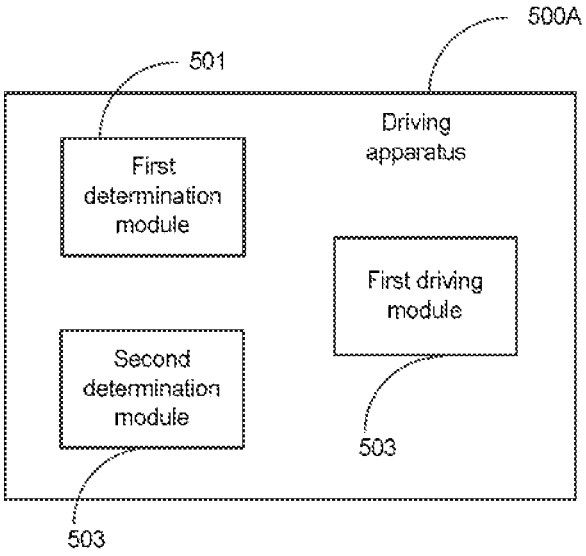
FIG. 5A illustrates a schematic structural diagram of a driving apparatus according to an embodiment of the present disclosure.

FIG. 5A illustrates a schematic structural diagram of a driving apparatus according to an embodiment of the present disclosure. As shown in FIG. 5A, the driving apparatus 500A according to the embodiment of the present disclosure may comprise a first determination module 501 configured to determine a first backlight signal value of each of the plurality of backlight regions according to input grayscale values of pixels in an image to be displayed. The driving apparatus 500A may further comprise a second determination module 502 configured to determine second backlight signal values according to the first backlight signal values of the plurality of backlight regions and a preset backlight diffusion function. The driving apparatus 500A may further comprise a first driving module 503 configured to drive each of the plurality of backlight regions to emit light using the second backlight signal value of the backlight region.

It may be understood by those skilled in the art that the functional modules in the driving apparatus 500A according to the embodiment of the present disclosure may be used to implement various functions of the exemplary driving method according to the embodiments of the present disclosure, for example, the driving method described above with reference to FIGS. 1 to 4, which will not be described in detail here for simplicity.

Figure 5B:
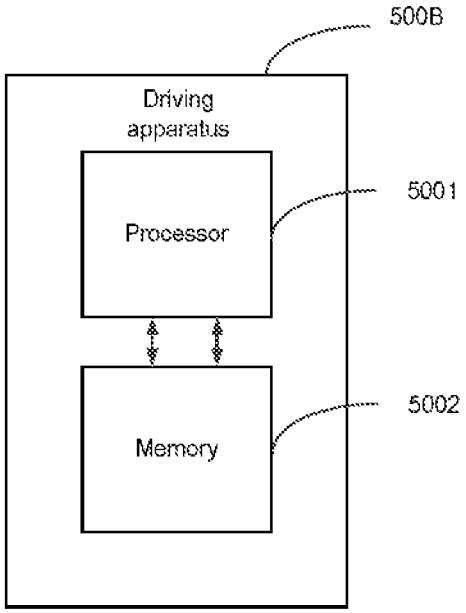
FIG. 5B illustrates a schematic structural diagram of a driving apparatus according to another embodiment of the present disclosure.

FIG. 5B illustrates a schematic structural diagram of a driving apparatus according to another embodiment of the present disclosure. As shown in FIG. 5B, the driving apparatus 500B according to the embodiment of the present disclosure may comprise at least one processor 5001 and a memory 5002. The memory 5002 may have instructions stored therein. The at least one processor 5001 executes the instructions stored in the memory 5002 to implement the driving method according to the embodiments of the present disclosure.

It may be understood by those skilled in the art that, the driving apparatus 500B according to the embodiment of the present disclosure may implement various functions of the exemplary driving method according to the embodiments of the present disclosure, for example, the driving method described above with reference to FIGS. 1 to 4, by the processor 5001 executing the instructions stored in the memory 5002, which will not be described in detail here for simplicity.

In addition, the first backlight signal values and the second backlight signal values of the respective backlight regions obtained in the above plurality of steps, and other parameters generated during the image display processing etc. may be stored in the memory 5002, and are invoked by the processor 5001 when needed.

Figure 6:
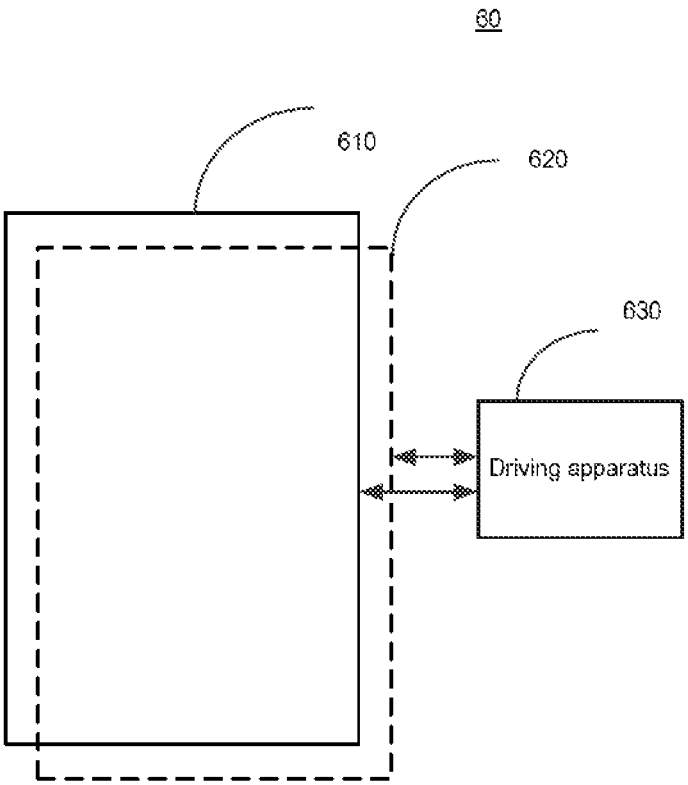
FIG. 6 illustrates a schematic structural diagram of a display device according to an embodiment of the present disclosure.

FIG. 6 illustrates a schematic structural diagram of a display device according to an embodiment of the present disclosure. As shown in FIG. 6, the display device 60 according to the embodiment of the present disclosure may comprise a display panel 610, a backlight module 620 and a driving apparatus 630. The driving apparatus 630 may be, for example, the driving apparatus in the embodiment shown in, for example, FIG. 5A, or may also be the driving apparatus in the embodiment shown in, for example, FIG. 5B.

It may be understood by those skilled in the art that the display device 60 according to the embodiment of the present disclosure may be any product or component having a display function, for example, an electronic paper, a mobile phone, a tablet computer, a television, a display, a notebook computer, a digital photo frame, a navigator etc.

According to the technical solutions of the embodiments of the present disclosure, there are provided a display device and a method for driving the same, a driving apparatus, and a computer-readable medium. The desired backlight signal values (the first backlight signal values) are determined by using the statistical information of the input grayscale values (i.e., the original pixel grayscale values) of the pixels in the image to be displayed, the second backlight signal values of the respective backlight regions are inversely inferred using the desired backlight signal values and the preset backlight diffusion function, and the backlight module is driven to emit light using the second backlight signal values of the backlight regions, so that the backlight signal values of the respective backlight regions may be set in consideration of the influence of the brightness of the respective backlight regions on the pixel grayscale values of the image to be displayed, which enhances the display contrast and improves the display effects without increasing the power consumption of the backlight module.

It should be illustrated that functions described herein as being implemented by pure hardware, pure software, and/or firmware may also be implemented by a combination of dedicated hardware, general purpose hardware, and software. For example, functions described as being implemented by dedicated hardware (for example, Field Programmable Gate Array (FPGA), Application Specific Integrated Circuit (ASIC), etc.) may be implemented by a combination of general purpose hardware (for example, Central Processing Unit (CPU), and Digital Signal Processor (DSP)) and software, and vice versa.

The present disclosure has been described in conjunction with the embodiments. It should be understood that those skilled in the art may make various other changes, substitutions, and additions without departing from the spirit and scope of the embodiments of the present disclosure. Therefore, the scope of the embodiments of the present disclosure is not limited to the specific embodiments described above, but should be defined by the appended claims.

We claim:

1. A method for driving a display device comprising a backlight module, the backlight module comprising a plurality of backlight regions, and the method comprising:

determining a first backlight signal value of each of the plurality of backlight regions according to input grayscale values of pixels in an image to be displayed;

determining a second backlight signal value of each of the plurality of backlight regions according to the first backlight signal values of the plurality of backlight regions and a preset backlight diffusion function; and driving each of the plurality of backlight regions to emit light using the second backlight signal value of the backlight region, wherein determining a second backlight signal value of each of the plurality of backlight regions according to the first backlight signal values of the plurality of backlight regions and a preset backlight diffusion function comprises: obtaining the second backlight signal value of each of the plurality of backlight regions through an iterative operation based on the first backlight signal values of the plurality of backlight regions and the preset backlight diffusion function, wherein the iterative operation comprises: performing the iterative operation using the following formula:

$$F_{k=1}=F_k+\beta\cdot(G-H*F_k)$$

wherein $F_k$ is a set of second backlight signal values of the plurality of backlight regions obtained in a $k^{th}$ iteration, $F_{k+1}$ is a set of second backlight signal values of the plurality of backlight regions obtained in a $(k+1)^{th}$ iteration, k is an integer greater than or equal to 0, β is a preset constant, G is a set of first backlight signal values of the plurality of backlight regions, and H is the preset backlight diffusion function which is a g×g Gaussian function matrix, wherein g is equal to (2×j+1), and j is a natural number.

2. The method according to claim 1, wherein obtaining the second backlight signal value by using an iterative operation comprises: in a condition where $$\frac{\|F_{k+1}-F_k\|}{\|F_k\|}\leq\varepsilon$$

is satisfied, using the set $F_{k+1}$ of second backlight signal values obtained in the $(k+1)^{th}$ iteration as the obtained set of second backlight signal values: otherwise, incrementing k by 1 and repeating the iterative operation, wherein ε is a preset constant.

3. The method according to claim 2, wherein $0<\varepsilon<0.1$.

4. The method according to claim 2, wherein $0<\beta<1$ and $0<\varepsilon<0.1$.

5. The method according to claim 4, wherein determining the first backlight signal values of the plurality of backlight regions comprises: for each of the plurality of backlight regions, calculating statistical information of input grayscale values of pixels in a sub-display region for the backlight region; and determining a first backlight signal value of the backlight region according to the statistical information.

6. The method according to claim 5, wherein the statistical information comprises one of a maximum value, a mean value, or a histogram distribution value of the input grayscale values of the pixels in the sub-display region.

7. The method according to claim 1, wherein $F_0=\beta\times G$.

8. The method according to claim 1, wherein $0<\beta<1$.

9. The method according to claim 1, wherein determining the first backlight signal values of the plurality of backlight regions comprises: for each of the plurality of backlight regions, calculating statistical information of input grayscale values of pixels in a sub-display region for the backlight region; and determining a first backlight signal value of the backlight region according to the statistical information.

10. The method according to claim 9, wherein the statistical information comprises one of a maximum value, a mean value, or a histogram distribution value of the input grayscale values of the pixels in the sub-display region.

11. The method according to claim 1, further comprising:

determining actual backlight values of the pixels in the image to be displayed according to the determined second backlight signal values and the preset backlight diffusion function;

determining output grayscale values of the pixels according to the actual backlight values of the pixels and the input grayscale values of the pixels; and driving a display panel to display the image to be displayed using the determined output grayscale values of the pixels.

12. A driving apparatus, comprising:

a memory configured to have instructions stored therein; and a processor configured to:

execute the instructions stored in the memory to implement the method according to claim 1.

13. A display device, comprising:

a display panel comprising a plurality of sub-display regions;

a backlight module comprising a plurality of backlight regions; and the driving apparatus according to claim 12.

14. A non-transitory computer-readable storage medium having stored therein instructions which are configured to, when executed by at least one processor, implement the method according to claim 1.

* * * * *